US011339699B2

(12) United States Patent
Holz et al.

(10) Patent No.: US 11,339,699 B2
(45) Date of Patent: May 24, 2022

(54) APPARATUS FOR THE AFTERTREATMENT OF EXHAUST GASES

(71) Applicant: Vitesco Technologies GmbH, Hannover (DE)

(72) Inventors: Oswald Holz, Schwalbach a. Ts. (DE); Peter Illhardt, Schwalbach a. Ts. (DE)

(73) Assignee: Vitesco Technologies GmbH, Hannover (DE)

( * ) Notice: Subject to any disclaimer, the term of this patent is extended or adjusted under 35 U.S.C. 154(b) by 0 days.

(21) Appl. No.: 17/043,116

(22) PCT Filed: Mar. 26, 2019

(86) PCT No.: PCT/EP2019/057525
§ 371 (c)(1),
(2) Date: Sep. 29, 2020

(87) PCT Pub. No.: WO2019/185595
PCT Pub. Date: Oct. 3, 2019

(65) Prior Publication Data

US 2021/0025309 A1 Jan. 28, 2021

(30) Foreign Application Priority Data

Mar. 29, 2018 (DE) ..... 10 2018 204 903.3

(51) Int. Cl.
*F01N 3/10* (2006.01)
*F01N 3/20* (2006.01)
*F01N 3/035* (2006.01)

(52) U.S. Cl.
CPC ..... *F01N 3/2013* (2013.01); *F01N 3/035* (2013.01); *F01N 2240/16* (2013.01);
(Continued)

(58) Field of Classification Search
CPC .... F01N 3/2013; F01N 3/035; F01N 2240/16; F01N 2240/36; F01N 2470/24; F01N 2260/14; F01N 3/2053
(Continued)

(56) References Cited

U.S. PATENT DOCUMENTS 2,674,197 A * 4/1954 Dudley ..... F01B 3/0008 91/54
5,950,576 A * 9/1999 Busato ..... F16K 11/0743 123/41.08
(Continued)

FOREIGN PATENT DOCUMENTS

CN 101205822 6/2008
DE 9202798 4/1992
(Continued)

OTHER PUBLICATIONS

English translation of Japanese Patent Document JPH0754640A (Year: 1995).*
(Continued)

*Primary Examiner* — Jason D Shanske
(74) *Attorney, Agent, or Firm* — Cozen O'Connor

(57) ABSTRACT

An apparatus for aftertreatment of exhaust gases of an internal combustion engine, with a housing through which the exhaust gas can flow from an inlet to an outlet, a flow path spatially delimited in a radial direction and through which gases can flow in an axial direction arranged inside the housing, a catalytic converter in the flow path, and a heating element arranged in the flow path for electrically heating the exhaust gas. An annular gap through which gases can flow is formed between the flow path and the inner wall of the housing. The distribution of the exhaust gas mass flow between the flow path and the annular gap is influenced by a control element.

7 Claims, 4 Drawing Sheets

(52) U.S. Cl.
CPC ..... *F01N 2240/36* (2013.01); *F01N 2470/24* (2013.01); *F01N 2610/02* (2013.01)

(58) Field of Classification Search
USPC ..... 60/300
See application file for complete search history.

(56) References Cited

U.S. PATENT DOCUMENTS 6,378,509 B1 * 4/2002 Feucht ..... F02M 26/43 123/568.12
7,171,801 B2 * 2/2007 Verkiel ..... F01N 3/0231 60/286
8,713,936 B2 * 5/2014 Joergl ..... F02M 26/16 60/605.2
9,657,464 B2 * 5/2017 Dunki-Jacobs ..... G05D 7/0617
10,000,347 B2 * 6/2018 Newton ..... B65G 53/4616
2005/0000208 A1 * 1/2005 Liu ..... F01N 3/0842 60/286
2006/0037594 A1 * 2/2006 Rutten ..... F02M 26/70 123/568.18
2006/0266025 A1 * 11/2006 Zheng ..... F01N 3/035 60/299
2007/0089399 A1 * 4/2007 Rhodes ..... F02D 41/005 60/278
2010/0192549 A1 * 8/2010 Gonze ..... F01N 9/002 60/287
2010/0313547 A1 * 12/2010 Gonze ..... F01N 3/2066 60/273
2011/0000194 A1 * 1/2011 Gonze ..... F01N 3/106 60/286
2012/0144811 A1 * 6/2012 Yamada ..... F02D 41/024 60/299
2012/0301376 A1 11/2012 Chivilikhin et al.
2014/0208944 A1 * 7/2014 Brenneis ..... F02M 43/00 95/20
2015/0089925 A1 * 4/2015 Kita ..... F02D 41/1446 60/274
2016/0369673 A1 * 12/2016 Hopka ..... F02D 41/1466
2019/0178141 A1 * 6/2019 Kim ..... H01L 35/30

FOREIGN PATENT DOCUMENTS

DE 4222162 1/1993
DE 10111787 9/2001
DE 102011077184 12/2012
DE 102012213187 2/2013
DE 102011013311 12/2015
DE 102015207573 10/2016
JP H0385315 4/1991
JP H 05-146686 6/1993
JP H0754640 2/1995
WO WO 2013104633 7/2013

OTHER PUBLICATIONS

Office Action of the corresponding German Patent Application No. 10 2018 204 903.3.
Office Action dated Oct. 8, 2021 issued in Chinese Patent Application No. 201980022893.0.

* cited by examiner

APPARATUS FOR THE AFTERTREATMENT OF EXHAUST GASES

CROSS REFERENCE TO RELATED APPLICATIONS

This is a U.S. national stage of Application No. PCT/EP2019/057525 filed Mar. 26, 2019. Priority is claimed on German Application No. DE 10 2018 204 903.3 filed Mar. 29, 2018 the content of which is incorporated herein by reference.

BACKGROUND OF THE INVENTION

1. Field of the Invention

The invention relates to an apparatus for aftertreatment of exhaust gases of an internal combustion engine, with a housing through which the exhaust gas can flow from an inlet to an outlet, a flow path arranged inside the housing, which is spatially delimited in a radial direction and through which gases can flow in an axial direction, at least one catalytic converter arranged in the flow path for catalytic conversion of the exhaust gas, and at least one heating element for electrically heating the exhaust gas arranged in the flow path and through which the exhaust gas can flow.

2. Description of Related Art

For faster heating of exhaust gas mass flows, electrically heatable catalytic converters are used. In addition to the heat quantity of the exhaust gas itself, a heat quantity is supplied to the exhaust gas by the electric heating system. This helps raise the temperature level of the exhaust gas mass flow more quickly to a level that allows adequate conversion of the exhaust gas in the exhaust gas catalytic converters. Conversion of the exhaust gas usually begins above a certain minimum temperature at the catalytic converter, which temperature must be reached before the chemical conversion reactions can begin. An increased temperature of the exhaust gas mass flow also leads to an increase in temperature at the catalytic converter due to the heat transport from the exhaust gas to the honeycomb body of the catalytic converter. The possible heating of the exhaust gas mass flow here depends firstly on the quantity of exhaust gas flowing through the electrically heatable catalytic converter per time unit, and secondly on the electrical energy used for heating.

The disadvantage of the systems known from the prior art for electric heating of the exhaust gas mass flow of an internal combustion engine is here in particular that the exhaust gas stream flowing through the electrically heatable catalytic converter is difficult or impossible to regulate. The mass flow through the electrically heated catalytic converter is thus determined solely by the respective operating situation of the internal combustion engine, for which reason, in particular for high exhaust gas mass flows, it may occur that a non-optimal heating of the exhaust gas mass flow takes place, whereby a time delay may occur until an adequate conversion of the exhaust gas is achieved in the catalytic converters of the exhaust gas aftertreatment unit.

SUMMARY OF THE INVENTION

It is therefore an object of one aspect of the present invention to create an apparatus for exhaust gas aftertreatment that allows improved heating of the exhaust gas mass flow using an electrically heatable catalytic converter, and thus ensure faster reaching of the minimum temperature of the exhaust gas mass flow for adequate conversion of the exhaust gas at the respective catalytic converters.

One aspect of the invention relates to an apparatus for the aftertreatment of exhaust gases of an internal combustion engine, with a housing through which the exhaust gas can flow from an inlet to an outlet, a flow path that is spatially delimited in a radial direction and through which gases can flow in an axial direction and which is arranged inside the housing, at least one catalytic converter arranged in the flow path for catalytic conversion of the exhaust gas, and at least one heating element arranged in the flow path and through which the exhaust gas can flow and which serves for electrically heating the exhaust gas, wherein an annular gap through which gases can flow is formed between the flow path and the inner wall of the housing, wherein the distribution of the exhaust gas mass flow between the flow path and the annular gap can be influenced by a control element.

A housing through which gas can flow is preferably formed by a tube that is in fluidic communication with the exhaust gas pipe of the internal combustion engine. Exhaust gas can thus flow directly into and through the apparatus. Inside the housing, a flow path is formed, which for example is also formed by a tube. The tube is delimited in the radial direction by its wall, whereby in practice two flow paths are formed inside the housing. Preferably, the flow path formed in the housing is arranged concentrically inside the housing, and therefore an annular gap is formed between the outer wall of the flow path and the inner wall of the housing. The flow path may be fixed relative to the housing via support elements.

Exhaust gas flowing into the housing can thus flow both through the annular gap and through the flow path. If no control element were provided, the distribution of the exhaust gas mass flow between the annular gap and the flow path would be substantially influenced by the cross-sectional areas of the two flow paths.

According to one aspect of the invention, at least one control element is provided that can be actively influenced so as to adjust the distribution of the exhaust gas mass flow between the annular gap and the flow path. The control element may be formed in various ways. In the descriptions below, particularly preferred embodiments of the control element are described.

It is particularly advantageous if the control element is formed by a rotatably mounted perforated panel, wherein the through-flow cross-section of the annular gap can be enlarged or reduced by rotation of the perforated panel.

A perforated panel may for example be formed by a ring arranged in the annular gap. The ring covers the flow cross-section of the annular gap and thus in one possible position blocks the exhaust gas flow through the annular gap. In this case, the entire exhaust gas stream flowing through the apparatus flows through the flow path arranged inside the housing and surrounded by the annular gap.

The perforated panel, corresponding to its function, has holes, which are for example, arranged so as to be spaced apart from each other in the circumferential direction. By twisting the perforated panel relative to the housing or flow path, a flow cross-section of the annular gap can be opened so as to increase the proportion of the exhaust gas mass flow through the annular gap.

It is also advantageous if the perforated panel has a stationary portion and a portion mounted so as to be rotatable relative to this stationary portion, wherein both portions comprise orifices spaced apart from each other in the circumferential direction.

Such a design allows a plurality of orifices to be opened by twisting the rotatably mounted portion relative to the stationary portion, or the orifices which have been opened can be closed again by twisting. In particular, by twisting the perforated panel so that the orifices in the twistable part coincide with the orifices in the stationary part, a particularly large flow cross-section can be opened.

The maximum flow cross-section that can be opened may be defined depending on the type, number, and size of orifices in the perforated panel.

A preferred exemplary embodiment is characterized in that the control element is formed by an annular panel that is movable in the axial direction of the housing. An axially movable ring is particularly suitable for influencing the through-flow cross-section if either the inner wall of the housing and/or the outer wall of the housing tapers conically or widens conically.

By moving the annular panel, which has an unchanging, defined shape, the through-flow cross-section of the annular gap can be increased or reduced.

It is also preferred if the annular panel is arranged inside the annular gap between the flow path and the housing.

In addition, it is advantageous if the annular panel is movable relative to the housing and/or the flow path, wherein the annular panel has a defined opening cross-section. By moving the annular panel, the through-flow cross-section of the annular gap can be actively influenced. It is thus possible, depending on the prevailing operating conditions at the time, to achieve the most optimum distribution of the exhaust gas flow between the annular gap and the flow path.

It is furthermore advantageous if the annular panel has guide plates, wherein the exhaust gas mass stream flowing through the annular gap can be deflected by the guide plates. Guide plates are advantageous since the exhaust gas stream flowing through the annular gap can be influenced in a targeted fashion. Thus for example an eddy may be generated, whereby a better mixing can be achieved of the two exhaust gas streams after flowing through the flow path and the annular gap. Also, the flow in the annular gap may be made turbulent by the guide plates, which improves the heat transfer and can homogenize the temperature distribution or concentrations of the various exhaust gas constituents.

It is also suitable if the structure delimiting the flow path in the radial direction has rotatably mounted flaps as control elements. Rotatable flaps can be influenced in targeted fashion to open or close orifices. The flaps can be actively adjusted depending on the actual desired distribution of exhaust gas flow between the flow path and the annular gap, whereby the overflow between the flow path and the annular gap is controlled.

In addition, it is advantageous if the rotatably mounted flaps are mounted so as to be rotatable about axes oriented in the axial direction. "In the axial direction" means parallel to the main through-flow direction of the apparatus. Flaps mounted so as to be rotatable about axial rotational axes thus allow an orifice in the radial direction to be opened, so that the exhaust gas can flow out of the flow path into the annular gap, outwardly in the radial direction. In an advantageous embodiment of the apparatus, the exhaust gas flows into the flow path arranged concentrically in the housing, and from there, when the flaps are completely closed, past the heating element and into the catalytic converters arranged in the flow path or downstream of the flow path. In this position of the flaps, an overflow into the annular gap surrounding the flow path is suppressed. In this flap position, the annular gap acts as a thermally insulating air cushion which reduces a heat loss from the flow path towards the environment of the housing. In this flap position, exhaust gas does not actively flow through the annular gap.

The further the flaps are opened, the greater the proportion of the exhaust gas mass flow overflowing from the flow path into the annular gap.

Furthermore, it is suitable if the flaps can open orifices that allow an at least partial overflow of the exhaust gas mass flow from the flow path into the annular gap. This is advantageous for achieving a division of the exhaust gas mass flow between the flow path and the annular gap.

It is also suitable if the flow path is arranged in the housing such that the exhaust gas stream can only flow through the annular gap via the orifices that can be opened by the flaps. This is advantageous for better influencing of the distribution of the exhaust gas stream between the flow path and the annular gap.

It is also preferred if, as control elements, swirl flaps are arranged in the annular gap and mounted to be rotatable about radially oriented axes. In addition, it is advantageous if a flow cross-section of the annular gap can be opened by twisting the swirl flaps.

By twisting the flaps about their respective rotational axes, swirl flaps in the annular gap can enlarge or reduce the through-flow cross-section of the annular gap and also close it completely depending on the design of the swirl flaps.

It is furthermore advantageous if the swirl flaps are arranged in the annular gap so as to be spaced apart from each other in the circumferential direction. The number of swirl flaps, their size and mutual spacing can also influence the flow cross-section which can be opened.

It is also suitable if the flow path is formed by a casing tube arranged inside the housing.

Advantageous developments of the present invention are described in the dependent claims and in the following description of the figures.

BRIEF DESCRIPTION OF THE DRAWINGS

The invention will be explained in detail in the following text on the basis of exemplary embodiments with reference to the drawings, in which.

DETAILED DESCRIPTION OF THE PRESENTLY PREFERRED EMBODIMENTS

Figure 1:
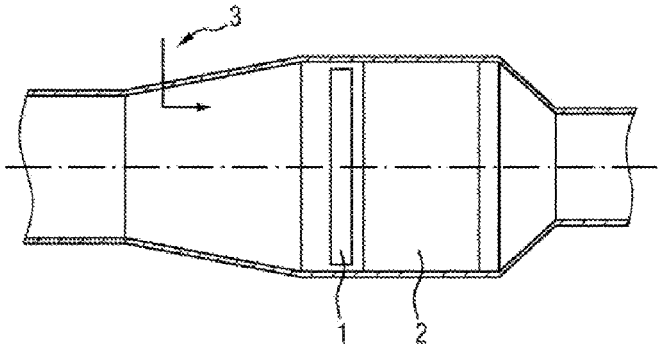
FIG 1 PRIOR ART
FIG. 1 is a sectional view through a conventional apparatus for exhaust gas aftertreatment.

FIG. 1 is a sectional view through an apparatus for exhaust gas aftertreatment. This is formed by a housing with regions of different diameters. A device 1 for heating the exhaust gas flow is arranged inside the housing, and downstream thereof a catalytic converter 2, which serves for aftertreatment of exhaust gases. In addition, the apparatus may have elements for the addition of operating media 3, in order for example to introduce a watery urea solution or fuel into the apparatus.

The apparatus shown in FIG. 1 is in particular characterized in that the entire exhaust gas stream, which flows through the apparatus from left to right, flows completely through the heating element 1 and the downstream catalytic converter 2. If the exhaust gas mass flow does not have the temperature necessary for heating the catalytic converter 2 to a temperature sufficient for its operation, the entire exhaust gas mass flow must be heated by the heating element, so as also to heat the catalytic converter 2. For this, a large energy quantity is required since the entire mass flow must be heated.

Figure 2:
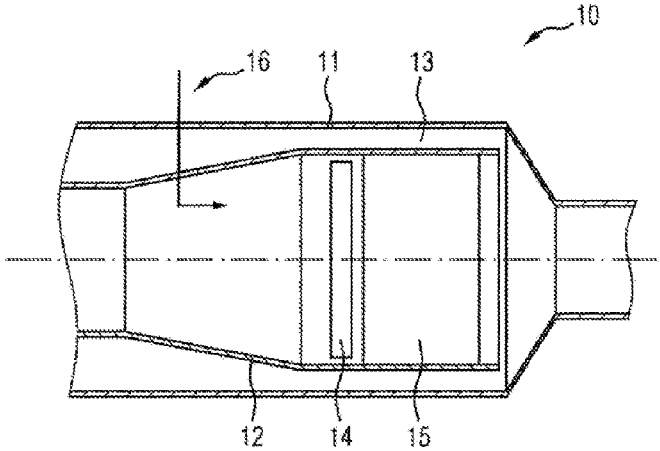
FIG. 2 is a sectional view through an apparatus according to the invention for exhaust gas aftertreatment.

FIG. 2 shows an sectional view through an apparatus 10 according to one aspect of the invention. This has a housing 11 and a tube 12 therein, which forms a flow path delimited in the radial direction. An annular gap 13, through which the exhaust gas can flow, is formed between the tube 12 and the housing 11.

The through-flow direction of the housing 11 and the flow path is left to right.

A heating element 14 for electrical heating of the exhaust gas is arranged inside the tube 12. Furthermore, a catalytic converter 15 is arranged downstream inside the tube 12 for aftertreatment of the exhaust gas flowing through it. The catalytic converter 15 is in particular formed by a metallic or ceramic honeycomb body provided with a corresponding surface coating in order, by a chemical reaction, to remove undesirable constituents from the exhaust gas or to reduce their concentration, or to convert the added operating media by a chemical reaction. This includes for example the conversion of watery urea solution into ammonia or the generation of heat from added fuel.

In alternative embodiments, several catalytic converters may be arranged inside the tube. Operating media, such as for example a watery urea solution or fuel, may be added to the apparatus in the direction of the arrow marked with reference sign 16.

Exhaust gas flowing through the apparatus 10 can flow directly through the annular gap 13, which thus forms a bypass around the flow path formed by the tube 12. Alternatively, the exhaust gas can flow directly into the flow path 12 and around or through the elements arranged in the flow path 12. After flowing through the flow path 12, the two flow routes converge again and flow further in a common pipe.

The exemplary embodiment of FIG. 2 shows the fundamental structure of an apparatus according to the invention for the treatment of exhaust gases. FIG. 2 does not show a control element that is inserted to influence the distribution of the exhaust gas mass flow between the annular gap 13 and the flow path in the tube 12. Possible embodiments are described in detail in the following figures.

Figure 3:
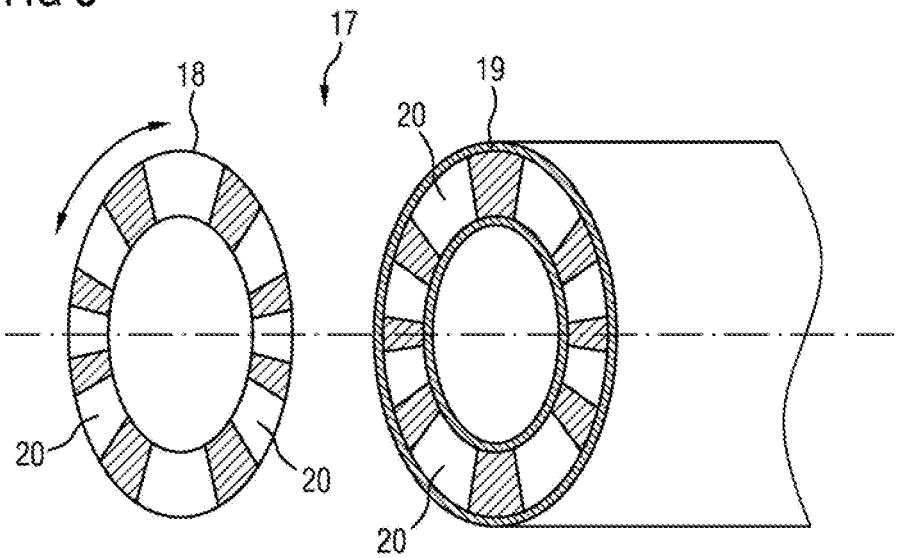
FIG. 3 is a perspective view of a control element in the form of a rotatable perforated panel.

FIG. 3 shows a view of a control element 17 which is formed as a rotatable perforated panel. The perforated panel 17 is formed from a rotatably mounted element 18 and a stationary element 19. The two elements 18, 19 of the perforated panel 17 have orifices 20, which are spaced apart from each other in the circumferential direction. As shown, the stationary portion 19 comprises orifices 20 that are spaced apart from each other in a circumferential direction, and the mounted portion 18 comprises orifices 20 that are spaced apart from each other in the circumferential direction. When these orifices 20 are brought to coincide with each other by twisting of the element 18, exhaust gas can flow directly into the annular gap behind. If the orifices 20 are twisted completely against each other, the flow path into the annular gap is blocked and the exhaust gas flows completely through the flow path in the interior of the central tube.

The depiction in FIG. 3 is exploded to guarantee greater clarity. In an actual embodiment, the two elements 18, 19 sit directly on each other. The tube forming the flow path may protrude beyond the perforated panel 17 or terminate flush with the perforated panel 17. The perforated panel 17 is preferably arranged on the inflow side of the annular gap. It may however be arranged at any point of the annular gap.

Figure 4:
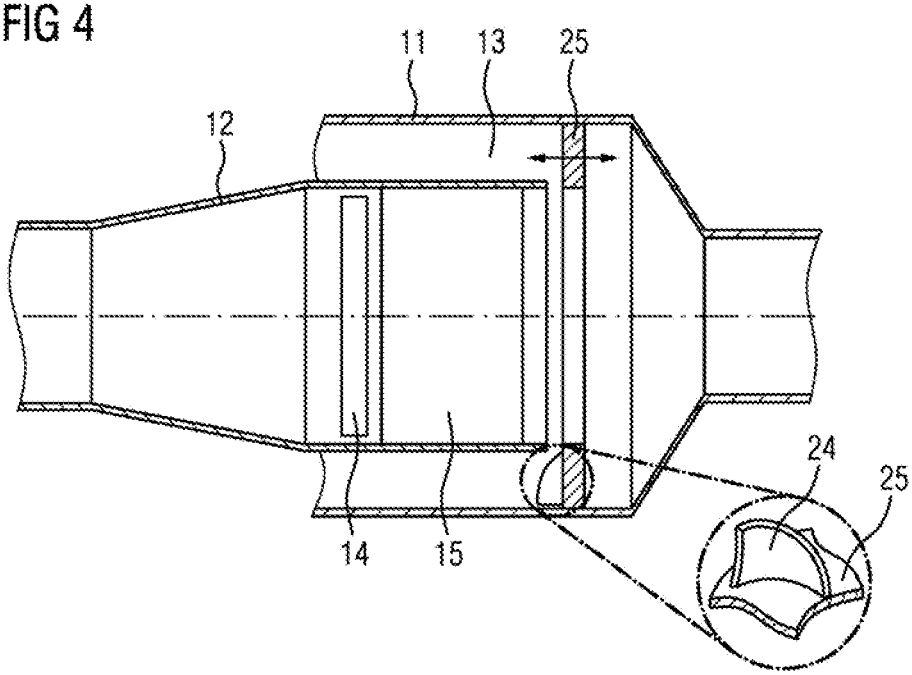
FIG. 4 is a sectional view through an apparatus for exhaust gas aftertreatment.

FIG. 4 shows a possible embodiment of the control element as an axially movable annular panel 25. The annular panel 25 is arranged on the outflow side 21 of the tube 12, and configured such that the cutout in a centre of the panel 25 corresponds to the inner diameter of the tube 12. When the panel 25 is moved to the left towards the tube 12, the panel 25 may come to rest on the tube 12, whereby the annular gap 13 is completely closed. In this case, the exhaust gas flowing through the apparatus cannot flow through the annular gap 13 and must flow completely through the flow path 12 and hence through the heating element 14 and the catalytic converter 15.

By moving the annular panel 25 axially to the right, i.e. away from the tube 12, a flow path may be opened so that exhaust gas can flow from the annular gap 13 past the panel 25 and mix with the exhaust gas flowing through the tube 12. In the example shown, the annular panel 25 is guided on the inner wall of the housing 11 and can be moved axially in the main through-flow direction of the apparatus 10. The largest possible opening between the annular gap 13 and the panel 25 may be defined by the maximum spacing of the panel 25 relative to the tube 12 which can be achieved in the axial direction.

Swirl-generating elements 24, such as for example guide plates, may be arranged on the annular panel 25 in order to cause turbulence in the flow in the annular gap 13 and hence achieve a better mixing inside the annular gap 13. Also, a turbulent flow contributes to improved mixing when the exhaust gas streams meet downstream of the tube 12 and annular gap 13. Furthermore, the heat transfer to the housing 11 is reduced by the turbulent peripheral flow, which also reduces heat losses.

Figure 5:
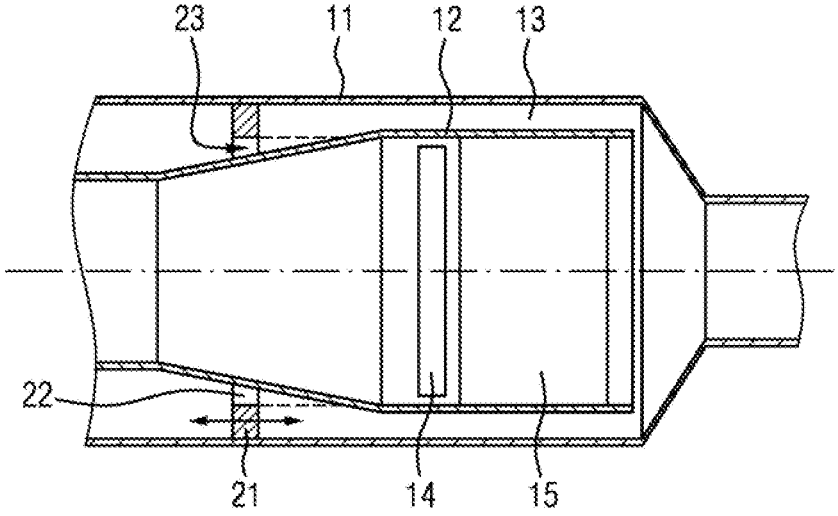
FIG. 5 is a sectional view through an alternative embodiment of an apparatus for exhaust gas aftertreatment.

FIG. 5 shows an alternative apparatus in which the axially movable annular panel 21 is arranged at an alternative position inside the apparatus 10. The annular panel 21 is arranged inside the annular gap 13. The annular panel 21 has a central cutout 22 through which the tube 12 is guided. The annular panel 21 is arranged in a region in which the outer diameter of the tube 12 widens conically in the flow direction. By moving the form-stable annular panel 21 in the axial direction, the opening gap 23 between the annular panel 21 and the tube 12 can be enlarged or reduced, whereby the proportion of exhaust gas flowing through the annular gap 13 can also be enlarged or reduced.

If the annular panel 21 is moved axially fully to the right, the annular panel 21 comes into contact with the outer wall of the tube 12 and the annular gap 13 is completely closed. The exhaust gas then flows completely through the flow path inside the tube 12.

If the flow path through the annular gap is completely closed, the annular gap acts as a thermal insulator between the exhaust gas and the elements inside the flow path formed by the tube and the housing of the apparatus. This reduces an undesirable heat loss towards the outside.

Figure 6:
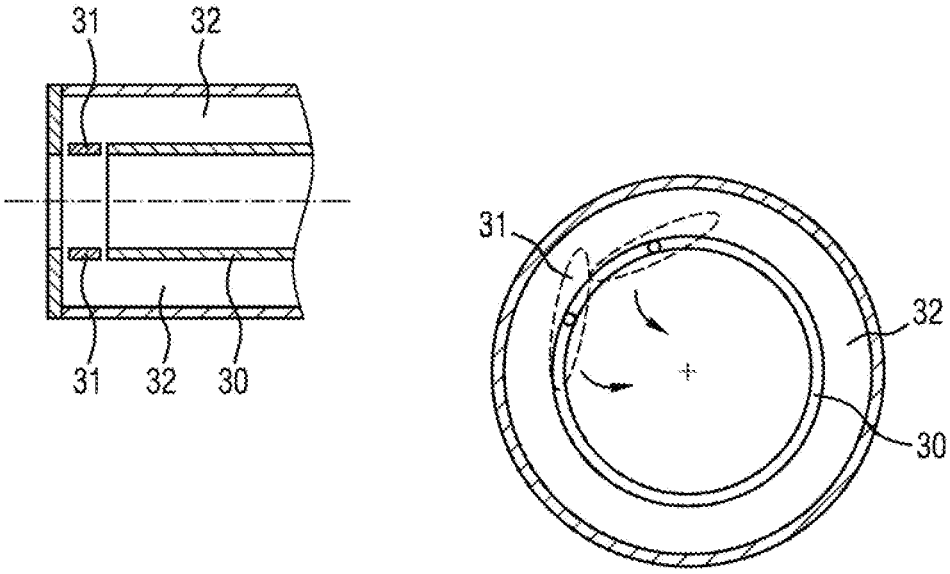
FIG. 6 is a sectional view through an apparatus for exhaust gas aftertreatment.

FIG. 6 shows an alternative embodiment characterized in that the entire exhaust gas stream flows completely into the flow path formed by the tube 30, and from there overflows into the annular gap 32 or on through the tube 30, depending on the position of the control elements 31 shown.

The control elements 31 are formed by rotatably mounted flaps that each have rotational axes oriented in the axial direction. By twisting the flaps 31, orifices in the radial direction can thus be opened or closed, whereby an overflow between the tube 30 and the annular gap 32 is enabled or prevented.

Advantageously, several flaps 31 may be distributed over the circumference of the tube 30. The flaps 31 may comprise guide elements which additionally deflect the exhaust gas flowing through the opened orifices, in order for example to generate a turbulent flow.

Figure 7:
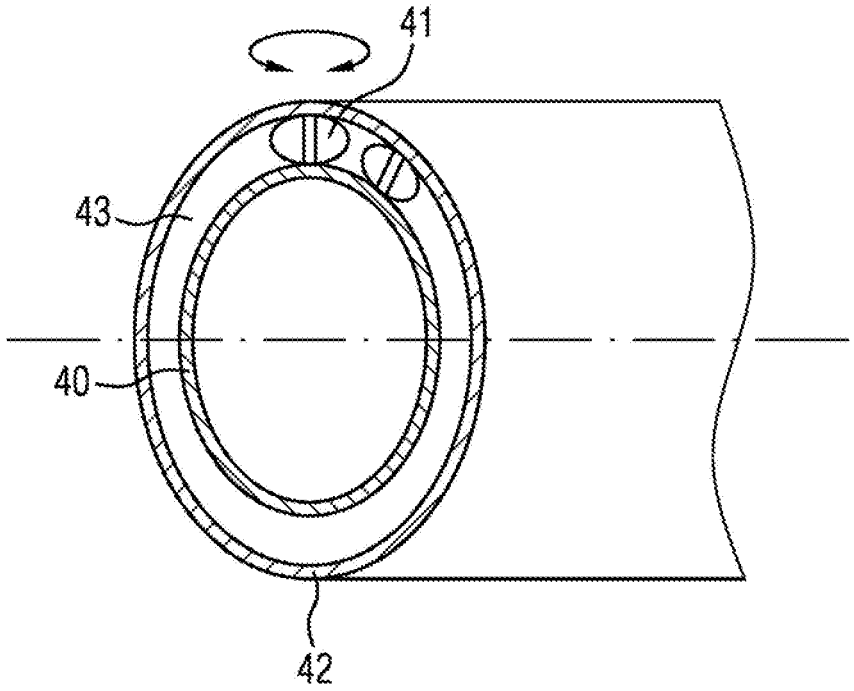
FIG. 7 shows a perspective view of an apparatus for exhaust gas aftertreatment.

FIG. 7 shows a further alternative embodiment, wherein here the control elements 41 are formed by rotatably mounted flaps 41 arranged between the tube 40 and the housing 42. The flaps 41 are mounted so as to be rotatable about axes running in the radial direction, and can thus open orifices in the axial direction. The flaps 41 are arranged in the annular gap 43.

In an advantageous embodiment, several flaps 41 may be distributed over the circumference of the annular gap 43. In addition to the elements shown in FIG. 7, a further element may be arranged in the annular gap 43 that covers the regions lying between the flaps, so that no flow can take place through the annular gap 43 past the flaps. Such an element, which may be configured as a ring with corresponding cutouts, is then required if the aim is to be able to close the annular gap 43 completely. The different features of the individual exemplary embodiments can also be combined with one another. The exemplary embodiments in FIGS. 1 to 7 are in particular not of a limiting nature and serve for illustrating the concept of the invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An apparatus for aftertreatment of exhaust gases of an internal combustion engine, comprising:

a housing through which the exhaust gases can flow from an inlet to an outlet;

a flow path defined by an inner wall arranged inside the housing that is spatially delimited in a radial direction having a constant cross sectional entry area and through which the exhaust gases can flow in an axial direction;

at least one catalytic converter arranged in the flow path for catalytic conversion of the exhaust gases;

at least one heating element arranged in the flow path and through which the exhaust gases can flow and configured to electrically heat the exhaust gases;

an annular gap through which the exhaust gases can flow is formed between the flow path and the inner wall of the housing; and a distributor having an annular shape with an inner diameter that corresponds with a diameter of the flow path at least at one axial position of the flow path and an outer diameter that corresponds to an inner diameter of the housing and configured to vary an exhaust gas mass entering the annular gap by varying an entry area of the annular gap.

2. The apparatus as claimed in claim 1, wherein the distributor comprises:

a rotatably mounted perforated panel, wherein a through-flow cross-section of the annular gap can be enlarged or reduced by rotation of the perforated panel.

3. The apparatus as claimed in claim 2, wherein the perforated panel comprises a stationary portion and a mounted portion that is configured to rotate relative to the stationary portion, wherein the stationary portion comprises orifices that are spaced apart from each other in a circumferential direction, and wherein the mounted portion comprises orifices that are spaced apart from each other in the circumferential direction.

4. The apparatus as claimed in claim 1, wherein the distributor is an annular panel that is movable in the axial direction of the housing.

5. The apparatus as claimed in claim 4, wherein the annular panel is arranged inside the annular gap between the flow path and the housing.

6. The apparatus as claimed in claim 5, wherein the annular panel is movable relative to the housing and/or the flow path, wherein the annular panel has a defined opening cross-section.

7. The apparatus as claimed in claim 5, wherein the annular panel has guide plates, wherein the guide plates are configured to deflect the exhaust gas mass flow through the annular gap.

* * * * *